US006860754B2

(12) United States Patent
Weiss

(10) Patent No.: US 6,860,754 B2
(45) Date of Patent: Mar. 1, 2005

(54) LEAD RETENTION BUSHING

(75) Inventor: Paul J. Weiss, Elkhart Lake, WI (US)

(73) Assignee: Thomas Industries Inc., Sheboygan, WI (US)

( * ) Notice: Subject to any disclaimer, the term of this patent is extended or adjusted under 35 U.S.C. 154(b) by 0 days.

(21) Appl. No.: 10/354,235

(22) Filed: Jan. 29, 2003

(65) Prior Publication Data

US 2004/0147160 A1 Jul. 29, 2004

(51) Int. Cl.[7] ..... H01R 13/58
(52) U.S. Cl. ..... 439/458
(58) Field of Search ..... 439/456–458, 439/449, 469, 466

(56) References Cited

U.S. PATENT DOCUMENTS 4,188,003 A * 2/1980 Ramsey ..... 248/56
4,223,178 A * 9/1980 Lass ..... 174/65 R
4,389,082 A * 6/1983 Lingaraju ..... 439/472
6,123,573 A * 9/2000 Savicki, Jr. ..... 439/469

FOREIGN PATENT DOCUMENTS

EP 0 526 324 A1 * 7/1992 ..... H01R/13/58

* cited by examiner

*Primary Examiner*—Gary Paumen
*Assistant Examiner*—Edwin A. Leon
(74) *Attorney, Agent, or Firm*—Quarles & Brady LLP

(57) ABSTRACT

A conductor lead and power cord retention system for a compressor/pump has a unique bushing for capturing and pinching the cord in an opening in the pump housing. The bushing has a leading end defining an open-ended slot. The bushing slides into a pocket in the housing and overlaps an open-ended slot in the housing. Overlapping the slots creates a bounded (circular for example) opening sized to snuggly pinch the cord sheathing without damaging the conductors. The slots are shaped and sized to accommodate a variety of cord diameters. The bushing is retained in the recess by a pair of angled snap tabs that engage notches and further by mounting of the drive motor to the housing, which forces the bushing against the housing to prevent rattling as well as helps maintain the necessary pinch force and prevents the bushing from being removed without tools.

10 Claims, 5 Drawing Sheets

LEAD RETENTION BUSHING

CROSS-REFERENCE TO RELATED APPLICATIONS

Not applicable.

STATEMENT OF FEDERALLY SPONSORED RESEARCH OR DEVELOPMENT

Not applicable.

BACKGROUND OF THE INVENTION

The present invention relates to relieving pull strain on electric power cords, and in particular to a special strain relief bushing design.

Strain relief bushings and open-closed bushings are commonly used at the connection of power cords and electrical leads to the body of an electrical device. Such bushings mount into openings in the housings of the devices to protect the conductor leads and can clamp the sheathing or insulation surrounding the conductor leads so that if the cord is pulled on the leads are not torn loose from the motor. Protecting the leads and relieving the strain on the leads reduces the chance that the electrical connection will be disrupted.

These bushings must perform sufficiently to satisfy national agency standards (such as United Laboratories), for example, regarding being irremovable from the device without tools and regarding the amount of pulling force they can sustain for a given time.

The bushings must clamp the cord to grip the sheathing sufficiently to meet these standards without excessively pinching the conductor leads. Consequently, the bushings must provide a properly sized opening for the cord. If the opening is too large, the bushing will not properly clamp the cord. If it is too small, it may pinch the conductors excessively. The chassis of the power cords can vary in size based on the number of conductors, the conductor gauge and the thickness of the sheathing required for particular applications. Thus, conventional bushings are made with various incrementally sized openings designed for use with cords of specific diameters. The need for numerous bushings for the various chord diameters can incur costly inventory and production expenses.

Accordingly, an improved universal bushing and cord retention system meeting industry standards is needed.

SUMMARY OF THE INVENTION

In one aspect the invention provides a lead retention bushing for attachment to an electrical device at an opening through which a conductor lead extends. The bushing has a leading end defining a slot opening away from a trailing end of the bushing. A snap tab extends at an oblique angle between the leading and trailing end.

In a preferred form, the bushing includes a pair of snap tabs extending in the same direction at an oblique angle with respect to the leading and trailing ends. The trailing end can be T-shaped and the snap tabs can be located on opposite sides of a stem portion of the T-shaped trailing end.

In other preferred forms, the housing and the bushing are plastic, and the snap tabs are deflectable to change their angle of extension. The closed ends of the slots in either or both of the bushing and the housings can be any desired shape, for example, semi-circular (a U-shaped slot) or with generally squared inside corners (a rectangular slot)

In another aspect the invention provides a power cord retention system, particularly suited for use in a pump unit. The system includes a housing and a bushing. The housing has an open face, preferably at which a drive motor mounts to the housing. An open-ended pocket is formed in the housing wall and has a slot and tracks on opposite sides of the slot, all opening at the open face. The bushing has lateral sides slideably received in the tracks and having a leading end, a trailing end and a snap tab. The snap tab extends at an oblique angle to the leading and trailing ends and is engagable with a notch formed in the housing to retain the bushing to the housing. The leading end of the bushing defines an open-ended slot opening at a leading edge thereof and overlapping a portion of the housing slot so as to define a bounded opening therebetween.

Again, the bushing preferably has a pair of deflectable, angled snap tabs in which case the housing would be formed with a pair of opposed notches opening to the inside of the housing slot. The system can further include a drive motor mounted to the housing at the open face to apply a retaining force against the trailing end of the bushing which forces the tabs of the bushing to deflect against a side of the notches and thus limit movement (such as vibration and rattling) of the bushing with respect to the housing.

The invention thus provides a low-cost bushing that can act as a strain relief bushing or an open-closed bushing. The bushing can be easily assembled to a device to protect non-corded leads and/or to relieve strain on the cord connection by applying a clamping force to the cord sheathing without damaging the conductors. The clamping force is sufficient to withstand substantial pulling force (preferably at least 35 pounds). With the snap tabs engaged in the notches and the motor assembled to the housing, the bushing is prevented from rattling and the necessary clamping force is maintained. Removal of the bushing without tools is also prevented. Further, the shape and size of the slots can be configured to accommodate a variety of lead or cord diameters with a single bushing.

These and other advantages of the invention will be apparent from the detailed description and drawings.

DETAILED DESCRIPTION OF THE PREFERRED EMBODIMENTS

Figure 1:
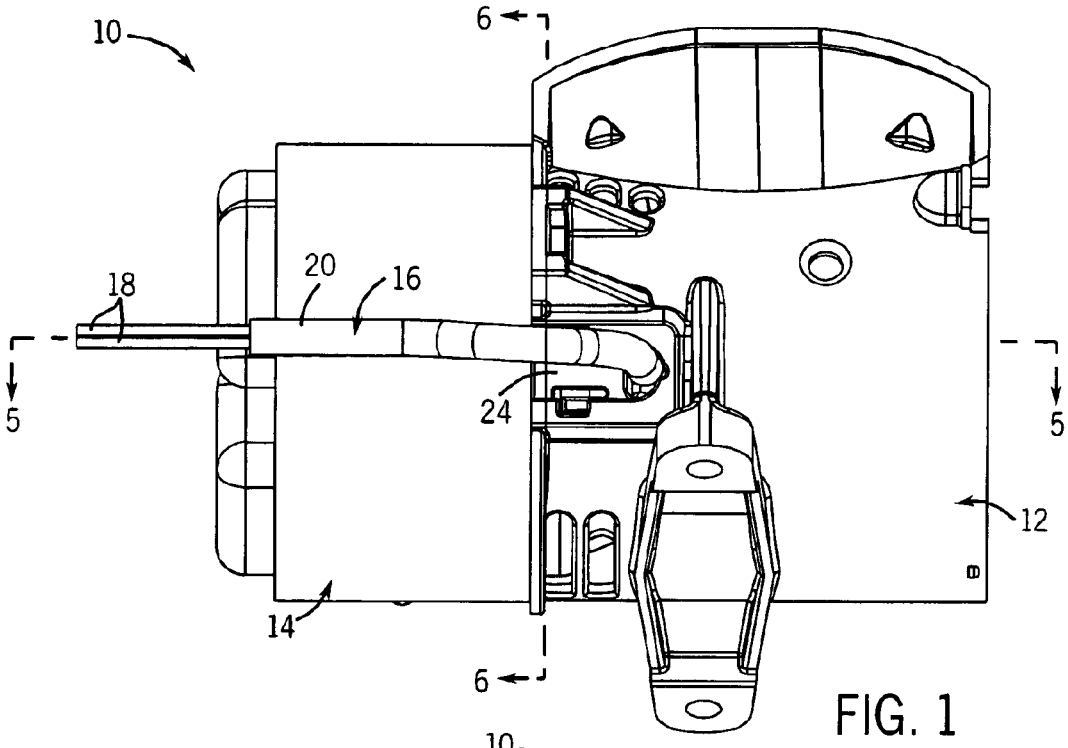
FIG. 1 is a side plan view of a pump/compressor unit incorporating the power cord retention system and lead retention bushing of the present invention.
Figure 2:
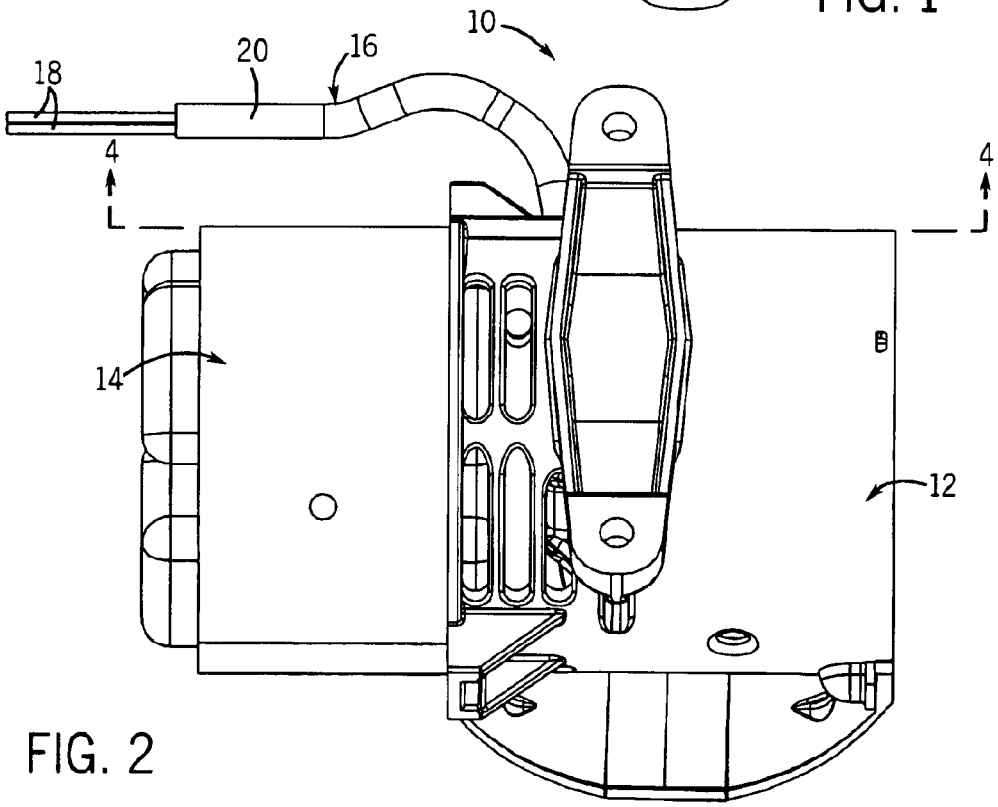
FIG. 2 is another side plan view of the unit of FIG. 1
Figure 3:
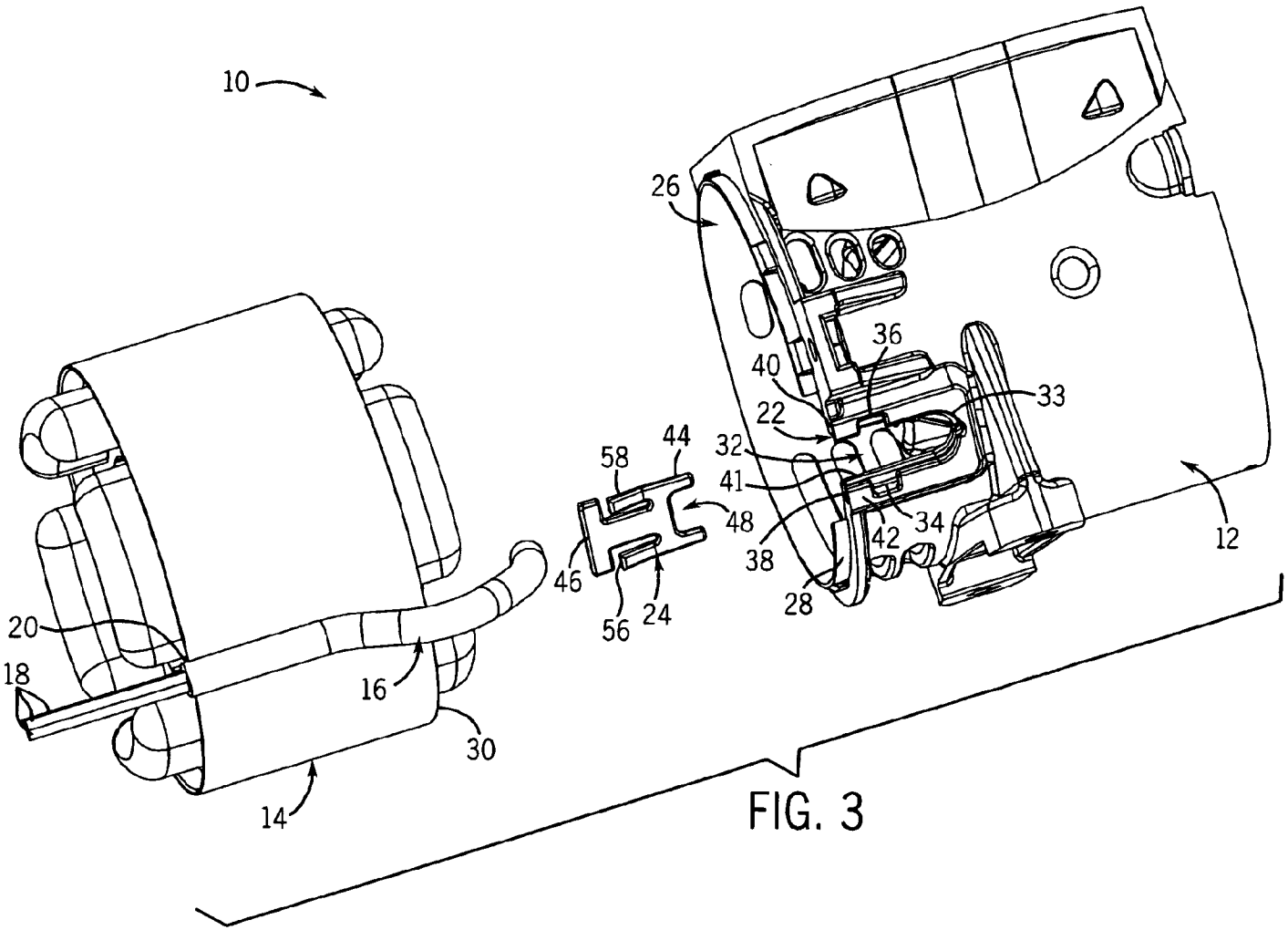
FIG. 3 is an exploded perspective view of the unit of FIG. 1.

Referring to FIGS. 1–3, the present invention provides a power cord retention system with a lead retention bushing.

Figure 7A:
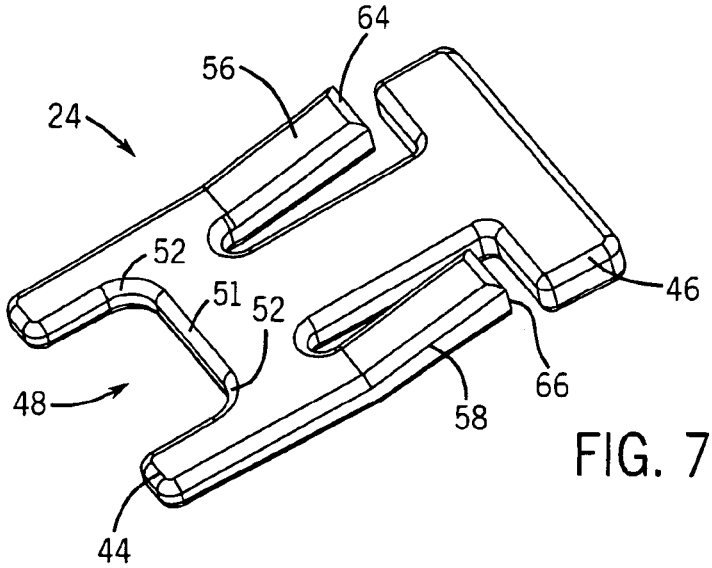
FIGS. 7A and 7B show perspective views of two embodiments of the bushing, the bushing in FIG. 7A being a strain relief bushing and the bushing in FIG. 7B being an open-closed bushing.
Figure 7B:
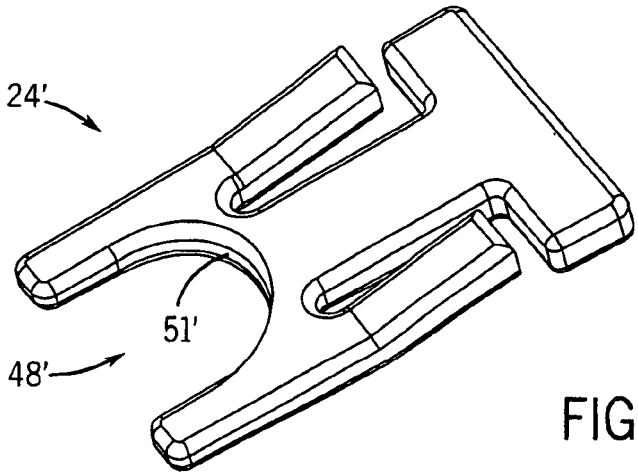
Figure 8A:
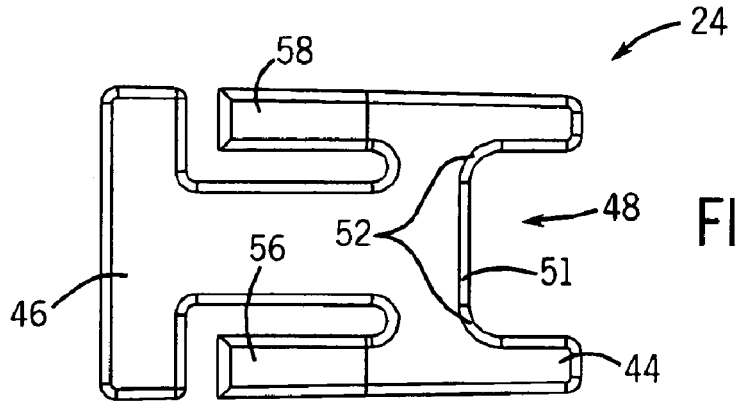
FIGS. 8A and 8B show top plan views of the two embodiments of the bushing.
Figure 8B:
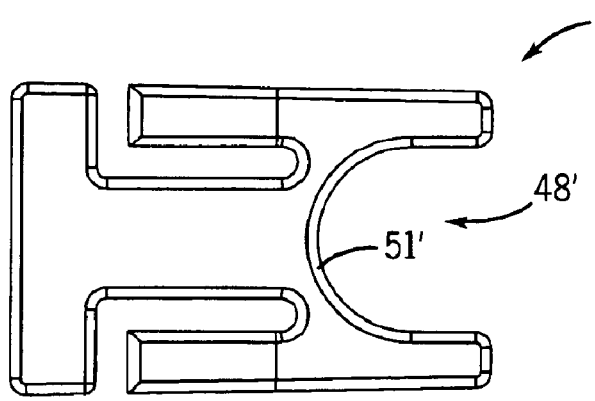
Figure 9A:
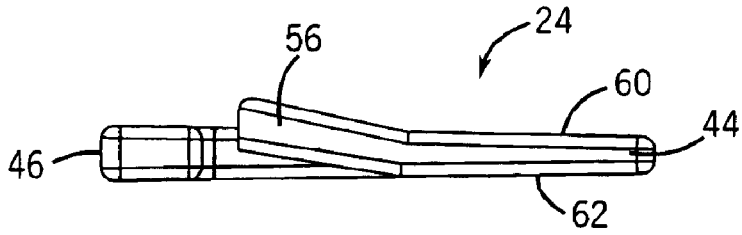
FIGS. 9A and 9B show side plan views of the two embodiments of the bushing.
Figure 9B:
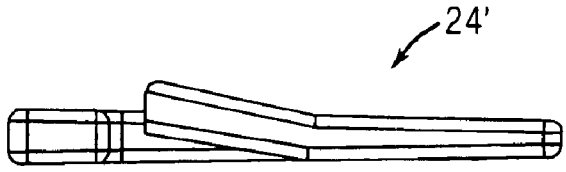

The bushing can be characterized as either a "strain relief bushing", such as shown in FIG. 7A, for clamping against a power cord or as an "open-closed bushing" (or "lead-edge protector"), such as shown in FIG. 7B for protecting the lead edge of individual conductive leads (not part of a cord arrangement).

In either case, the bushing is particularly suited for use with a compressor/pump 10 having associated piston/cylinder assemblies (not shown) contained in a crankcase housing 12 to which is mounted an AC drive motor 14. The motor 14 has a either a power cord 16 with three conductor leads 18 contained in its insulating sheathing 20 (or separate conductor leads not contained in a cord sheathing).

The housing 12 is preferably generally cylindrical and made of a suitable plastic. The wall of the housing 12 is formed with a pocket 22 for receiving a bushing 24, as described in detail below. In particular, the housing 12 has an open face 26 with a rabbetted periphery 28 which engages with a circumferential lip 30 of the motor shell. The pocket 22 extends axially in the thickness of the wall of the housing 12 back from the open face 26. The pocket 22 defines an axial slot 32 opening at the open face 26 and having a generally semi-circular closed end 33. A pair of opposing notches 34 and 36 are formed in an outer wall 42 of the housing 12 spaced from the open face 26 and opening to the inside of the slot 32. The pocket 22 further defines a pair of parallel tracks 38 and 40 extending axially from the open face 26 on each side of the slot 32, the tracks 38 and 40 being simple grooves or channels opening to the open face 26 and extending circumferentially further in opposite directions than an inner 41 and outer 42 wall of the housing 12.

Figure 4:
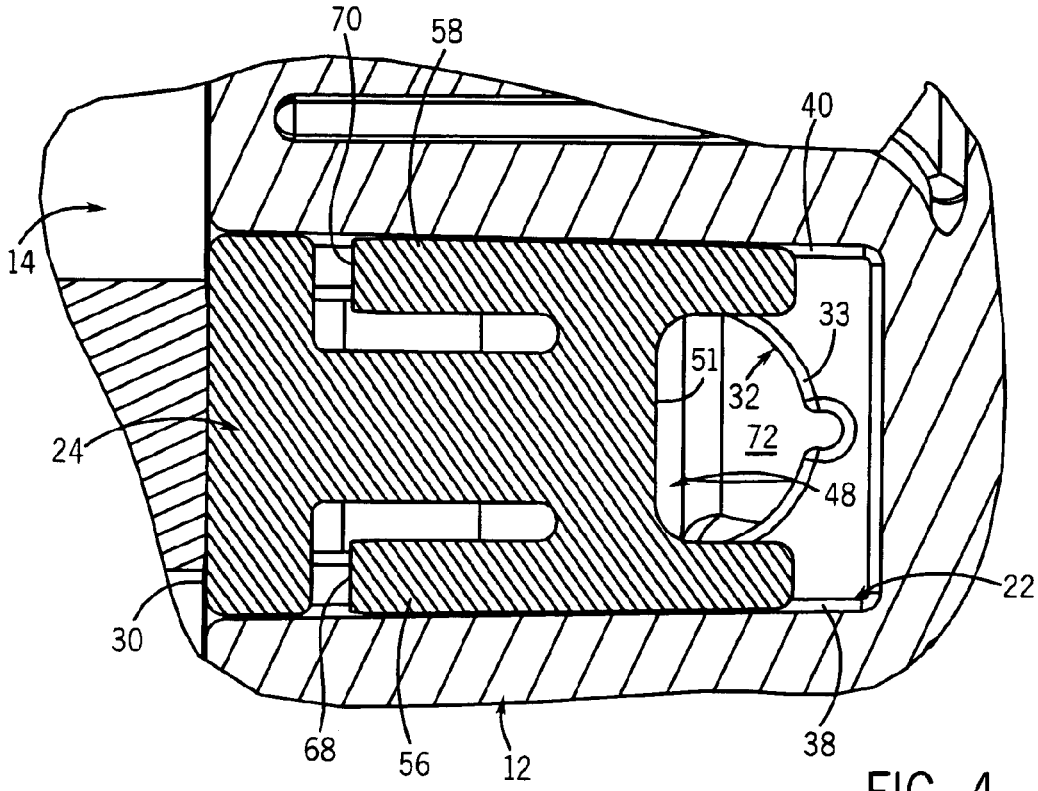
FIG. 4 is a partial cross-sectional view taken along line 4—4 of FIG. 2 showing the bushing assembled in a pocket of the unit's housing.
Figure 6:
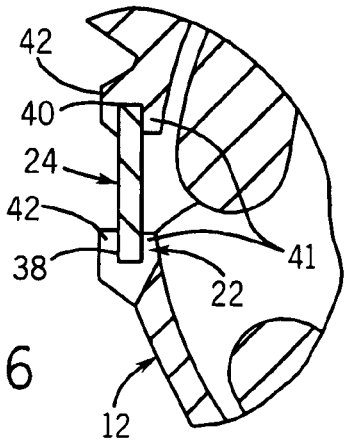
FIG. 6 is a partial cross-sectional view taken along line 6—6 of FIG. 1.

Referring to FIGS. 3–4 and 7A–9A, the a strain relief version of the bushing 24 is a suitable plastic, preferably polybutylene terephthalate, commercially available as Valox® 357 from the General Electric Company. The bushing 24 defines a leading end 44 and a generally T-shaped trailing end 46. The leading end 44 defines a generally rectangular slot 48 opening away from the trailing end 46 of the bushing 24 and having a closed end 51 with generally squared inside corners 52 (albeit with some draft radius). Two snap tabs 56 and 58 extend from the leading end 44 spaced from the stem and cross-member of the T-shaped trailing end 46 at an oblique angle from the generally co-planer leading 44 and trailing 46 ends. Preferably, the snap tabs 56 and 58 extend in the same direction at approximately 10–15 (preferably 12) degrees. The snap tabs 56 and 58 as well as the lateral edges of the leading 44 and trailing 46 ends are generally parallel and are sized to be slidably received in the grooved tracks 38 and 40 of the housing pocket 22, as shown in FIGS. 4 and 6.

Figure 5:
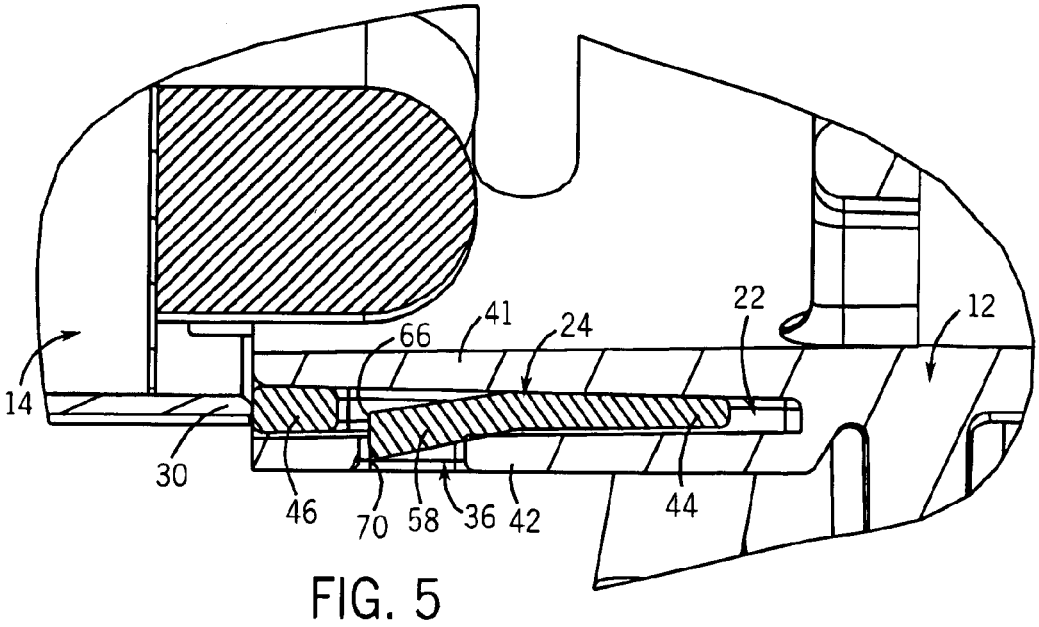
FIG. 5 is a partial cross-sectional view taken along line 5—5 of FIG. 1 showing a snap tab of the bushing engaged in a notch formed in the housing.

Referring to FIG. 5, the snap tabs 56 and 58 are somewhat resilient and deflectable in the thickness direction between outer 60 and inner 62 sides of the bushing 24 (to change their angle of extension). The snap tabs 56 and 58 extend toward the cross-member of the trailing end 46 at a distance selected so that the ends of the snap tabs 56 and 58 fit it the notches 34 and 36 when the bushing 24 is seated in the recess 22. Because the snap tabs 56 and 58 are angled, they flatten (or deflect radially inward) as the bushing 24 is slid into the recess 22, which causes an internal spring force biasing the snap tabs 56 and 58 toward their original angled position (radially outward). When the bushing 24 is slid into the recess 24 far enough so that the free ends of the snap tabs 56 and 58 reach the notches 34 and 36, this spring force drives the ends of the snap tabs 56 and 58 inward to snap into the notches 34 and 36. The bushing 24 can then only be backed out of the pocket 22 by manually flattening (or deflecting) the snap tabs 56 and 58 so that snap tab edges 64 and 66 clear edges 68 and 70 of the notches 34 and 36, respectively. By mounting the motor shell onto the housing, the bushing is driven further into the recess 22 such that the snap tabs 56 and 58 wedge into and deflect against front edges of the notches 34 and 36. The motor thus securely holds the snap tabs 56 and 58 against one edge of the notches 34 and 36 to prevent the bushing from rattling when the pump is operated. The assembly of the motor also assists in the clamping of the cord as well as to make the bushing even more difficult to remove without tooling.

Referring again to FIGS. 1 and 4, when the bushing 24 is slid fully into the pocket 22 with its leading end 44 first, the slots 32 and 48 overlap axially despite being radially offset. Because the slots 32 and 48 are oriented to open in opposite directions, the closed ends 33 and 51 of the respective slots form a bounded cord opening 72 for the power cord 16. The cord opening 72 can be any suitable shape and size. The configuration shown in FIG. 4 provides suitable clamping of the cord sheathing 20 (without excessively crimping the conductive leads 18) to alleviate strain on the leads 18 from a 35 pound pull force applied for one minute, as required by United Laboratories for compressors.

FIGS. 7B–9B illustrate an open-closed bushing 24', being otherwise as described above but formed with an alternate configuration of the slot 48', shown here with the slot 48' being generally U-shaped slot with a generally semi-circular closed end 51'. The semi-circular closed ends 33 and 51' thus forming a circular or oval cord opening 72' when assembled and overlapping the axial slot in the housing. This rounded configuration is preferred for use with separate conductor leads (without a cord) to protect the leads from wearing due to contact with the motor housing during operation.

Again like above, when the drive motor 14 is assembled to the housing 12, the lip 30 of the motor shell abuts the trailing end 46 of the bushing 24 and forces it to one side of the recess 22 to maintain its position, prevent rattling of the bushing as well as make tooling even more necessary to dislodge the bushing 24 from the housing 12.

The invention thus provides a low-cost and easily assembled cord retention system with a unique strain relief bushing. With the snap tabs engaged in the notches and the motor assembled to the housing, the necessary clamping force is maintained on the cord sheathing and removal of the bushing without tools is prevented. Further, the shape and size of the slots can be configured to accommodate a variety of cord diameters with a single sized bushing.

Illustrative embodiments of the present invention have been described above in detail. However, the invention should not be limited to the described embodiments. To ascertain the full scope of the invention, the following claims should be referenced.

What is claimed is:

1. A power cord retention system for an electrical device, comprising:

a housing having an open motor receiving face and formed with a pocket defining a slot with a notch opening to the interior of the slot and tracks on opposite sides of the slot, the slot and tracks opening to the open face; and a bushing having lateral sides slideably received in the tracks and having a leading end, a trailing end and a snap tab, the snap tab extending between and at an oblique angle to the leading and trailing ends and being engagable with the notch to retain the bushing to the housing, the leading end defining an open-ended slot opening away from the trailing end and overlapping a portion of the slot in the housing so as to define a bounded opening therebetween.

2. The system of claim 1, wherein the housing is further formed to include a second notch opening opposite the notch and wherein the bushing has a second snap tab extending at an oblique angle in the same direction as the snap tab and engagable with the second notch.

3. The system of claim 1, wherein a closed end of the bushing slot has essentially semi-circular and a closed end of the housing slot is essentially semi-circular.

4. The system of claim 1, wherein a closed end of the bushing slot has essentially square inside corners.

5. The system of claims 1, wherein the housing and the bushing are plastic.

6. The system of claim 1, wherein the electrical device is a pump including a drive motor received in the motor receiving face of the housing.

7. A power cord retention system for an electrical device, comprising:

a housing having an open face and formed with a pocket defining a slot with a notch opening to the interior of the slot and tracks on opposite sides of the slot, the slot and tracks opening to the oven face; and a bushing having lateral sides slideably received in the tracks and having a leading end, a trailing end and a snap tab, the snap tab extending between and at an oblique angle to the leading and trailing ends and being engagable with the notch to retain the bushing to the housing, the leading end defining an open-ended slot opening away from a trailing end and overlapping a portion of the slot in the housing so as to define a bounded opening therebetween;

wherein the electrical device is a pump including a drive motor;

wherein the motor is mounted at the open face of the housing so as to abut the trailing end of the bushing.

8. A power cord retention system for an electrical device, comprising:

a housing having an open face and formed with a pocket defining a slot with a notch opening to the interior of the slot and tracks on opposite sides of the slot, the slot and tracks opening to the open face; and a bushing having lateral sides slideably received in the tracks and having a leading end, a trailing end and a snap tab, the snag tab extending between and at an oblique angle to the leading and trailing ends and being engagable with the notch to retain the bushing to the housing, the leading end defining an open-ended slot opening away from a trailing end and overlapping a portion of the slot in the housing so as to define a bounded opening therebetween;

wherein the electrical device is a pump including a drive motor;

wherein the motor engages the bushing and causes the snap tab to deflect against one side of the notch so as to limit movement of the snap tab with respect to the housing.

9. The system of claim 8, further comprising a power cord clamped in the bounded opening between the bushing and the housing.

10. The system of claim 8, wherein the power cord is clamped in the bounded opening to remain fixed against a force of approximately 35 pounds pulling on the cord away from the bushing.

* * * * *

UNITED STATES PATENT AND TRADEMARK OFFICE

CERTIFICATE OF CORRECTION

PATENT NO. : 6,860,754 B2
DATED : March 1, 2005
INVENTOR(S) : Paul J. Weiss

It is certified that error appears in the above-identified patent and that said Letters Patent is hereby corrected as shown below:

Column 5,
Line 14, change "claims" to -- claim --
Line 24, change "oven" to -- open --

Column 6,
Line 11, change "snag" to -- snap --

Signed and Sealed this

Thirty-first Day of May, 2005

JON W. DUDAS
*Director of the United States Patent and Trademark Office*